US007117811B1

(12) United States Patent
Gramet et al.

(10) Patent No.: US 7,117,811 B1
(45) Date of Patent: Oct. 10, 2006

(54) ANCHOR LINE PRETENSIONING METHOD

(75) Inventors: Jean-Claude Gramet, Nice (FR); Douglas Bremner, Nice (FR)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 09/958,325

(22) PCT Filed: Apr. 10, 2000

(86) PCT No.: PCT/EP00/03202

§ 371 (c)(1),
(2), (4) Date: Dec. 2, 2002

(87) PCT Pub. No.: WO00/61434

PCT Pub. Date: Oct. 19, 2000

(30) Foreign Application Priority Data

Apr. 9, 1999 (EP) ..... 99201113

(51) Int. Cl.
*B63B 21/50* (2006.01)

(52) U.S. Cl. ..... 114/293

(58) Field of Classification Search ..... 114/293, 114/294, 144 B

See application file for complete search history.

(56) References Cited

U.S. PATENT DOCUMENTS 3,138,135 A 6/1964 Langer
3,167,049 A * 1/1965 Foster ..... 114/144 B
3,550,549 A * 12/1970 Horton ..... 114/230.24
3,577,946 A * 5/1971 Horton ..... 114/265
3,703,151 A * 11/1972 Clement ..... 114/230.24
6,216,628 B1 * 4/2001 Poldervaart ..... 114/293

FOREIGN PATENT DOCUMENTS

GB 2 258 852 2/1993

* cited by examiner

*Primary Examiner*—Sherman Basinger
(74) *Attorney, Agent, or Firm*—Young & Thompson

(57) ABSTRACT

An anchor line pretensioning method of an anchor line configuration that includes anchor lines (2, 3, 4) which are not diametrically opposed with respect to the structure that is moored to the seabed via the anchor lines. Two anchor lines (2, 3) on a first side of the installation vessel are mutually connected via a connecting member (13), such as for instance a triangular plate (13). The triangular plate (13) is connected to the vessel (10) in a fixed connection point or may be connected to a tensioning device on the vessel. During pretensioning, the pull force exerted on the tri-plate (13) is oriented in the same direction as the pull force exerted on the tensioning line (4) that is located on the opposite side of the vessel.

6 Claims, 2 Drawing Sheets

ANCHOR LINE PRETENSIONING METHOD

BACKGROUND OF THE INVENTION

The invention relates to an anchor line pretensioning method comprising the steps of:

connecting an anchor line with a first end and a tensioning line with a first end to the seabed, at opposite sides of an installation vessel, connecting the anchor line and the tensioning line with their second ends to the vessel, at least one line being connected to a tensioning device on the vessel, and pulling at least one line in its length direction towards the vessel.

Mooring systems for offshore structures, such as Floating Production Storage and Offloading Systems (FPSO's), spar buoys, barges and the like, usually comprise arrays of catenary anchor lines. These anchor lines extend along a curved trajectory from the floating structure, to the seabed. The anchor lines may be connected to the seabed by fluke anchors, suction anchors, driven piles or suction piles. In case drag anchors are used, it is necessary to apply a pretension load on the anchor lines after installation to bury the anchors in the seabed and to have the drag anchors develop their design holding power. In case other types of anchoring are used with deep attachment points, which may be located 5–10 meters below the surface of the seabed, the pretension load on the anchor lines will allow the lines to cut through the soil near the anchor pint such that future slackening of the anchor lines is prevented. Furthermore, in each case the pretension load on the anchor line ensures that the line is laid in a straight line along its required route for anchoring the offshore structure.

One way of tensioning anchor lines is to apply a load by the propulsion of one or more tugs. Another method is by pulling the anchor line against the anchor lines of the installation vessel by which the anchor lines are put in place. These methods may impose severe requirements on the installation spread and are relatively costly.

In case the anchor lines are arranged in an array comprising two anchor lines connected to diametrically opposed anchor points located on each side of the floating structure, the anchor lines can be pulled against each other on the installation vessel using either a pulling device across the deck, a crane or a subsea tensioner which requires a relatively cheap installation spread.

SUMMARY OF THE INVENTION

It is an object of the present invention to provide an anchor line pretensioning method which is relatively simple, cheap and effective. It is another object of the present invention to provide an anchor line pretensioning method which can be used for pretensioning anchor lines which are arranged in a non diametrically opposed configuration around the moored structure.

Hereto, the anchor line pretensioning method according to the present invention is characterized in that a second anchor line is connected to the seabed and to the vessel at the side of the first anchor line, wherein the anchor lines are mutually connected via a connecting member, which connecting member is attached to the vessel, and exerting a pull force exerted on the connecting member, the force being oriented in the direction of the tensioning line.

With the term "line" as used herein, chains, wire rope, steel or plastic cables and combinations thereof are intended. The tensioning line can be a temporary line member which is disconnected after the tensioning method is completed, or may be an anchor line of the floating structure that is to be moored to the seabed. The anchor lines used in the method of the present invention may have a length of between 500 and 5000 meters, whereas the pretensioning forces may range from 10 ton to 1000 ton.

If the mooring configuration comprises for instance three anchor lines arranged at 120° angles, two anchor lines at one side of the installation vessel are attached to the connecting member and pulled against the anchoring force of the third anchor line that extends at the opposite side of the installation vessel. In another configuration, such as a spread mooring configuration, two pairs of two anchor lines are tensioned simultaneously, each pair being mutually connected via the connecting member on a respective side of the vessel. The principle of the present invention is that the anchor lines on one side of the vessel are mutually connected to the connecting member, which in turn is connected to the vessel, such that the tensioning device on the vessel can apply the pretension load in the direction of the tensioning line, the pretension load being distributed across the anchor lines via the connecting member.

By means of the method according to the present invention, the anchor lines are stretched and aligned in their proper position. The exact positions of the ends of the anchor lines can now be measured and the proper weight of the clump weights that may be added to the anchor lines, and the length of the clump weight connection lines, can be recalculated and optionally be added to the chains, after which the floating structure can be connected. Furthermore, by the pretensioning method of the present invention the anchor line parts near the anchoring points are buried in the soil, wire rope parts of the anchor lines that are used are stretched such that stretch is removed and the lines are straightened such that any snaking is removed.

According to the present invention, the line on one side of the vessel may be directly connected to the vessel whereas the line on the opposite side of the vessel may be connected to a tensioning device, such as a winch or other known chain tensioning constructions such as pulley drives etc. Alternatively, the two lines on each side of the vessel can both be connected to a single tensioning device or to respective tensioning devices.

In a preferred embodiment, each anchor line is part of a group of anchor lines extending generally in the same direction, such as for instance a three by two, three by three or three by four arrangement, or a spread mooring in which a vessel, such as a barge, is moored on each corner point by a group of for instance three anchor lines. Each anchor line in a group can be pretensioned simultaneously with corresponding anchor lines in the other groups. During pretensioning, it is ensured that the connecting means are positioned in such a way that the anchor lines are located along their theoretical routes during application of the pretension load. By the method according to the present invention standard "cross-tensioning" equipment can be used for anchoring patterns in which the anchor lines are arranged in a non-diametrically opposed manner with respect to the floating construction that is to be anchored. With the method according to the present invention, two or more anchor lines are pretensioned at one time, which results in a time saving. Furthermore, the anchor lines are stretched in straight lines along their theoretical routes such that the proper pretension load is applied on the anchoring point in the right direction.

In one embodiment, the connecting member comprises a generally triangularly shaped plate. The anchor lines may be connected to the corner points of the so called "tri-plate". In a preferred method, the connecting member is detached from the anchor lines after pretensioning. Detaching of the connecting member may preferably be executed on the seabed in order to avoid that the lines are pulled out of their desired path, which could occur if the anchor lines were to be retrieved to the surface when still interconnected, for instance in order to recover the connecting member.

BRIEF DESCRIPTION OF THE DRAWINGS

The method according to the present invention will be explained in detail with reference to the accompanying, non limiting drawings. In the drawings.

DETAILED DESCRIPTION OF THE PREFERRED EMBODIMENTS

Figure 1A:
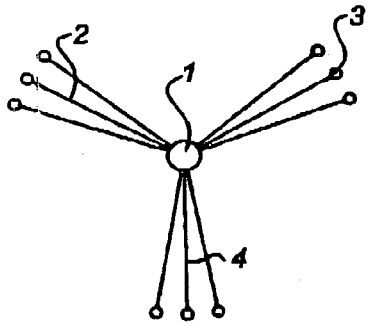
FIGS. 1*a* and 1*b* show two different mooring configurations comprising anchor lines which are arranged in non-diametrically opposed configuration with respect to the moored structure.
Figure 1B:
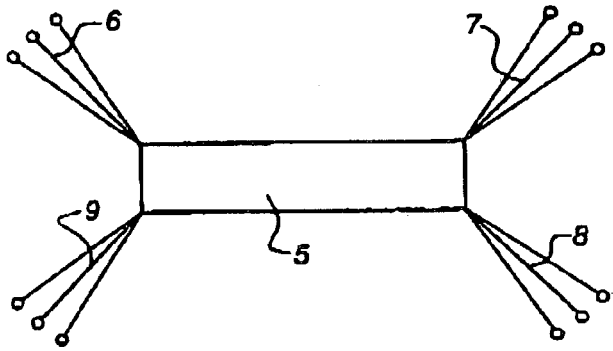

FIG. 1*a* shows a floating structure 1, such as a SPAR buoy or an FPSO, which is anchored to the seabed in a three by three anchor line arrangement. The anchor lines 2, 3, 4 are arranged in three groups of three anchor lines each. Another anchor line configuration is shown in FIG. 1*b* wherein a barge 5 is anchored in a spread mooring configuration comprising four groups of anchor lines 6, 7, 8, 9.

Figure 2A:
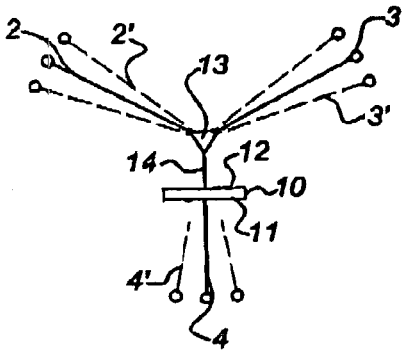
FIGS. 2*a* and 2*b* show the pretensioning method for the anchor line configurations shown FIGS. 1*a* and 1*b* respectively.

FIG. 2*a* shows how the anchor line configuration of FIG. 1*a* is pretensioned using an installation vessel 10. The anchor line 4 extends on a first side 11 of the installation vessel. On the second side 12 of the installation vessel 10, the anchor lines 2 and 3 are mutually interconnected via a connecting member, or tri-plate 13. The tri-plate 13 is of such configuration that the anchor lines 2, 3 extends along their theoretical directions, i.e. the directions which they will have when anchoring the floating structure 1 to the seabed. Via a line section 14, the tri-plate 13 is connected to the vessel 10. By hauling in the line section 14 and/or the anchor line 4, the anchor lines 2, 3 and 4 are pretensioned along their mooring directions.

After the pretensioning, the active linepart 14 is paid out such that the tri-plate 13 sinks to the bottom at the required mooring position, which may for instance be the center point of an FPSO. Prior to detaching the tri-plate (13), a pick-up-line with buoyancy member is attached to the tri-plate for recovery of the anchor lines 2 and 3 from the seabed and attachment to the moored structure.

Optionally, the ends of the anchor lines 2, 3 and 4 may be formed by temporary cable parts. After pretensioning, a pick-up line with buoyancy is attached to the end of anchor line 2, and line 14 is paid out such that tri-plate 13 sinks to its required position. Thereafter the temporary cable part of the anchor line 2 may be cut near its end to detach it from the tri-plate 13, for instance by a remote operated vehicle (ROV). The anchor line 4 is thereafter paid out, and a pick-up-line with buoyancy is attached to its end, whereafter the anchor line 4 is lowered on to the seabed. The installation vessel 10 is thereafter connected only to anchor line 3. A pick-up-line and buoyancy device may be connected to the tri-plate 13 and line 3 which may then be lowered on to the seabed, all three anchor lines 2,3,4 now being pretensioned and ready for connection to a floating structure.

Figure 2B:
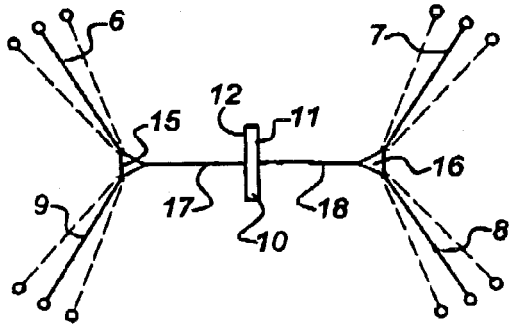

FIG. 2*b* shows the pretensioning method of the anchor lines 6,7,8,9 of the spread mooring shown in FIG. 1*b*. The anchor lines 6 and 9 are connected to a first tri-plate 15, whereas the anchor lines 7 and 8 at the opposite side 11 of the installation vessel 10 are connected to a second tri-plate 16. Both tri-plates 15,16 are connected to the vessel via respective cables sections 17, 18. One of the cable sections 17, 18 may be connected to a fixed connection point on the vessel whereas the other cable section may be connected to a tensioning device. It is also possible to attach each cable section 17, 18 to the tensioning device.

Figure 3:
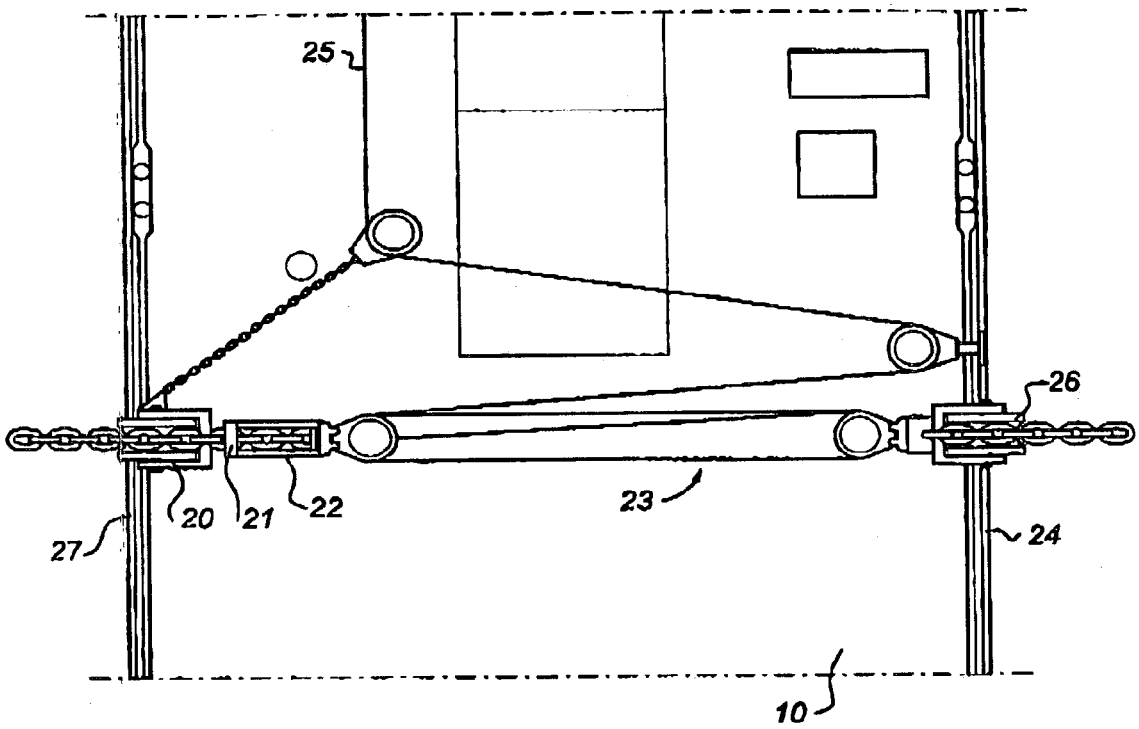
FIG. 3 shows a tensioning device on a vessel for applying a pretensioning load to the anchor lines.

FIG. 3 shows a tensioning device on the installation vessel 10 comprising a chain roller 20, a chain stopper 21 and a chain clamp 22 connected to one side 27 of the installation vessel 10. The chain clamp 22 can via a pulley system 23 be pulled towards the side 24 of the installation vessel by pulling cable 25 by means of a winch (not shown in the drawing). The anchor line at the side 24 may be fixedly attached to the chain roller 26 via a chain stopper, at the side 24 of the installation vessel 10.

The invention claimed is:

1. An anchor line pretensioning method comprising the steps of:

connecting a first end of a first anchor line and a first end of a tensioning line to the seabed at respective first and second anchoring points, said first anchor line and said tensioning line being at respective opposite first and second sides of an installation vessel;

connecting a second end of the first anchor line and a second end of the tensioning line to the installation vessel, at least one of said first anchor line and said tensioning line being connected to a tensioning device on the installation vessel;

connecting a second anchor line to the seabed at a third anchoring point spaced at a distance from the first anchoring point and to the installation vessel at said first side of the installation vessel;

mutually connecting the first and second anchor lines via a connecting member, said connecting member being attached to the installation vessel; and exerting a pull force on the connecting member, the pull force being oriented in a direction of the tensioning line such that the first and second anchor lines are pulled substantially along their theoretical routes away from the first and third anchoring points, wherein the connecting member comprises a generally triangularly shaped plate.

2. The method according to claim 1, wherein the tensioning line comprises an anchor line.

3. The method according to claim 1, wherein each anchor line is part of a group of anchor lines, the anchor lines in each group extending generally in a same direction.

4. An anchor line pretensioning method comprising the steps of:

connecting a first end of a first anchor line and a first end of a tensioning line to the seabed at respective first and second anchoring points, said first anchor line and said tensioning line being at respective opposite first and second sides of an installation vessel;

connecting a second end of the first anchor line and a second end of the tensioning line to the installation vessel, at least one of said first anchor line and said tensioning line being connected to a tensioning device on the installation vessel;

connecting a second anchor line to the seabed at a third anchoring point spaced at a distance from the first anchoring point and to the installation vessel at said first side of the installation vessel;

mutually connecting the first and second anchor lines via a connecting member, said connecting member being attached to the installation vessel; and exerting a pull force on the connecting member, the pull force being oriented in a direction of the tensioning line such that the first and second anchor lines are pulled substantially along their theoretical routes away from the first and third anchoring points, further comprising third and fourth anchor lines connected to another connecting member so that at least two anchor lines are connected to respective connecting members on each side of the installation vessel.

5. An anchor line pretensioning method comprising the steps of:

connecting a first end of a first anchor line and a first end of a tensioning line to the seabed at respective first and second anchoring points, said first anchor line and said tensioning line being at respective opposite first and second sides of an installation vessel;

connecting a second end of the first anchor line and a second end of the tensioning line to the installation vessel, at least one of said first anchor line and said tensioning line being connected to a tensioning device on the installation vessel;

connecting a second anchor line to the seabed at a third anchoring point spaced at a distance from the first anchoring point and to the installation vessel at said first side of the installation vessel;

mutually connecting the first and second anchor lines via a connecting member, said connecting member being attached to the installation vessel; and exerting a pull force on the connecting member, the pull force being oriented in a direction of the tensioning line such that the first and second anchor lines are pulled substantially along their theoretical routes away from the first and third anchoring points, wherein the connecting member is lowered onto the seabed after pretensioning and is subsequently retrieved and reused.

6. A floating structure comprising anchor lines that have been pretensioned by the method according to claim 1.

* * * * *